United States Patent [19]

Heidrich

[11] Patent Number: 4,842,159

[45] Date of Patent: Jun. 27, 1989

[54] TEMPORARY CLOSURE FOR BEVERAGE CAN

[76] Inventor: Dennis A. Heidrich, 174 Mac Arthur La., Erlanger, Ky. 41018

[21] Appl. No.: 234,563

[22] Filed: Aug. 22, 1988

[51] Int. Cl.[4] ..... A47G 19/22

[52] U.S. Cl. ..... 220/90.4; 220/90.2; 220/336

[58] Field of Search ..... 220/90.2, 90.4, 90.6, 220/336, 345, 351

[56] References Cited

U.S. PATENT DOCUMENTS

| | | | |
|---|---|---|---|
| D. 259,403 | 6/1981 | Frazier, Jr. | 220/90.4 X |
| 2,693,685 | 11/1954 | Stafford | 220/90.6 |
| 4,127,212 | 11/1978 | Waterbury | 220/90.4 X |
| 4,339,053 | 7/1982 | Tarro | 220/336 X |
| 4,366,914 | 1/1983 | Ingram | 220/90.4 X |
| 4,703,873 | 11/1987 | Geren | 220/90.6 X |
| 4,715,510 | 12/1987 | van der Meulen et al. | 220/90.6 X |
| 4,741,450 | 5/1988 | Braude | 220/90.2 X |
| 4,752,016 | 6/1988 | Eads | 220/366 X |

*Primary Examiner*—Stephen Marcus
*Assistant Examiner*—Nova Stucker

[57] ABSTRACT

A removable, rotatable closure is described for use on the top of a beverage can. The closure has a plate which covers the opening in the can to prevent contaminants from entering, and a ring to hold the plate in place. The ring is placed below the outside rim of the can, extending less than the full circumference of the can rim. The closure is easily rotated to expose the can opening while drinking, then is returned to its original position.

16 Claims, 1 Drawing Sheet

TEMPORARY CLOSURE FOR BEVERAGE CAN

BACKGROUND

1. Field of the Invention

This invention relates to a means for temporarily covering the opening in a can. In a particular embodiment, a beverage can opening is covered by the inventive device which is attached to the rim of the can.

2. Discussion of the Art

A need has long existed for a way to temporarily close cylindrical cans once they have been opened. Unlike other containers which may be re-sealed with screw-on caps or snap-on lids, most cans cannot be re-sealed after they are opened. Even if such cans cannot be tightly sealed, it is often desirable to temporarily cover the openings, especially on cans containing carbonated beverages, syrups, juices, and other food items, in order to minimize contamination.

Temporary coverings are most useful when such food containers are used outdoors, where dust, sand, and insects are a problem. Ants, flies, bees, and wasps seem especially attracted to open beverage containers, and can be a nuisance as well as a serious health hazard for persons allergic to insect stings. Although snap-on plastic lids are available to fit completely over the tops of some sizes of cans, they are cumbersome and cannot usually be manipulated with one hand.

SUMMARY

The invention is a closure which can be removably attached to the top of a can and rotated so as to temporarily cover the can opening. The closure has two parts, a plate and a ring, which form an integral piece.

The plate has an inner edge, side edges, and an outer edge which follows the curve of the can rim. It can be of any size, but must be large enough to substantially cover the opening.

A ring is attached to the plate and serves to hold the plate on the top of the can. During use the ring extends around the sidewall of the can beneath the rim. The ring is an incomplete circle, extending at least half but less than the full distance around the can.

The closure can be easily rotated on the can to expose the opening, and then returned to its original position.

PREFERRED EMBODIMENT

Figure 3:
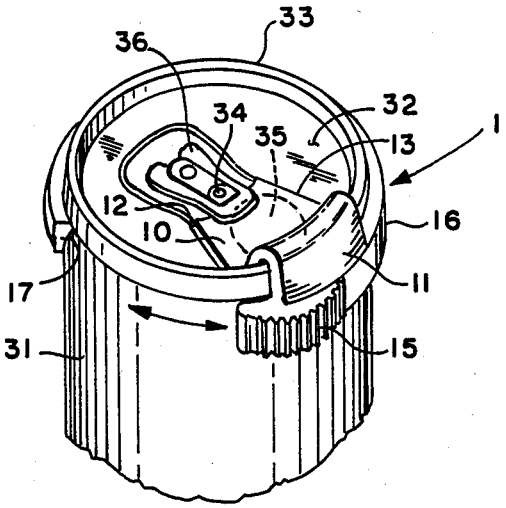
FIG. 3 is a perspective showing the closure in place on a beverage can.

In a preferred aspect of the invention, the closure is adapted to fit a standard 12 ounce beverage can, as shown in FIG. 3. The can has a sidewall 31, at top 32, a rim 33 at the junction of the sidewall and top, and a ring tab opener 36 mounted on a center pin 34. The inventive closure 1 is shown in place on the can with the plate 10 covering the hole 35, shown as a dotted line on the top of the can, and the ring 16 extending around the can below the rim 33.

Although shown with reference to a beverage can, the invention may be adapted for use with other cans having a top opening and can be of any size.

Figure 1:
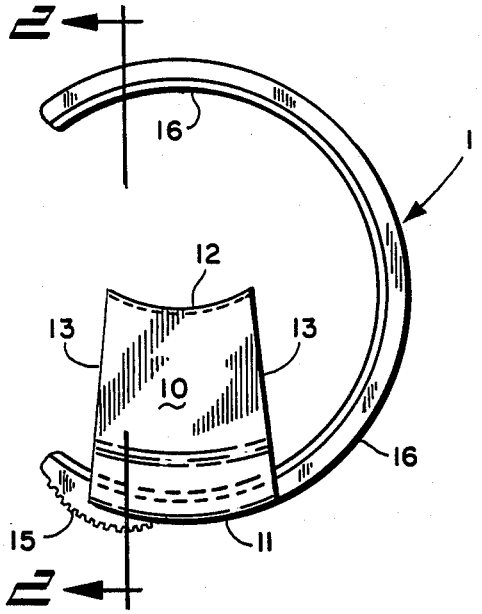
FIG. 1 is a plan view showing the closure with the plate and ring.
Figure 2:
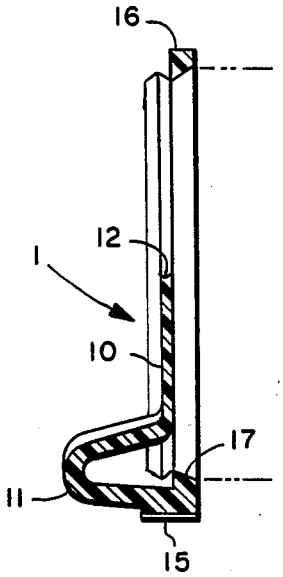
FIG. 2 is a side view of the plate and a portion of the ring, along the line shown in FIG. 1.

Referring to FIG. 1, the plate 10 has an outer edge 11 which is curved to about the same radius as the rim of the can on which it is used. The inner edge 12 is shown as concave, but may be straight, convex, pointed, or any other shape. The length of the plate 10 between the outer edge 11 and inner edge 12 can vary, but should be long enough to substantially cover the hole made in the top of a can. Preferably, the plate length is from about 0.5 to 1.5 inches. When used with standard beverage cans, the length is about 0.9 inches.

The side edges 13 of plate 10 can be straight or curved, as desired. The width between the side edges 13 can vary but should be a distance sufficient to cover the can's top hole. The width should preferably be kept to the minimum required because this allows for freer movement of the closure while on the can. The plate is preferably no more than 0.75 to 2 inches at its widest point.

The ring 16 is preferably an integral part of the closure 1, and is an incomplete or open circle such as shown in FIG. 1. The ring must extend less than 360 degrees, that is, it is not connected to itself so that it can be stretched open to fit over the rim of a can. It must extend more than 180 degrees so that it does not slip off the can. The ring preferably extends between about 220 degrees to 300 degrees, leaving a portion of the rim of the can exposed in the ring gap so that it will not contact the mouth of the user.

The inside diameter of the ring is about the same as the outside diameter of the can on which it is used, or about 2 to 3 inches, for many standard cans, and preferably about 2.25 inches for beverage cans.

As seen the cross-sectional side view FIG. 1, the ring 16 lies at, or preferably below, the plane formed by plate 10 so that it will fit outside and below the crimped rim found on many beverage cans. The height of the ring can vary, but need be no thicker than from 0.05 to about 0.25 inches. The inner surface 17 of the ring 16 can be flat, but is preferably shaped with a protrusion facing the center of the ring to help keep the ring from sliding upward off the top of the can. Inner surface 17 may, for example, be concave or ridged, and is preferably a pointed ridge.

The outer surface of the ring can have any appearance, smooth or textured. A smooth surface is easier to manufacture, but a textured surface allows the user to more easily grasp and turn the ring. More preferably, a bulge 15 is added to the ring 16 near the junction of ring 16 and plate 10. This bulge 15 provides a convenient means to turn the ring by applying pressure with a thumb or finger.

The plate 10 and ring 16 could consist of two pieces attached together, but are preferably a single unit such as can be molded from plastic. The plate can connect with the ring at any position, such as midway between the ends of the ring, or off-center, or near either end, such as shown in FIG. 1, the preferred position. Most preferably there is about $\frac{3}{8}$ inches of ring 16 extending to the left of the plate. This is sufficiet ot anchor the closure and also allows a gap in the ring near the can opening 35 when the closure is rotated counterclockwise. Left-handed drinkers may prefer the opposite configuration.

The closure is easily placed on the can be spreading the ends of the ring to fit past the diameter of the can.

When the can's pull tab 36 is lifted, the inner edge 12 of plate 10 can also help anchor the closure. For this reason, edge 12 is preferably thin enough and long enough to fit beneath a portion of the pull tab 36. For beverage cans with non-removable pull tabs, the inner edge 12 is best curved concavely with a radius of from about 0.25 to 0.75 inches.

Although the preferred embodiment has been described in detail, others will recognize that changes can be made without departing from the scope of my invention, which is limited only by the following claims.

I claim:

1. A closure for removable, rotatable attachment to a cylindrical can having a sidewall, a top, a rim at the junction of the sidewall and top, and an opening in the can top between the rim and center, the closure comprising:

a plate having an inner edge, side edges, and a curved outer edge with approximately the same radius as the can rim, the plate having a length between the inner and outer edges and a width between the side edges sufficient to substantially cover the opening in the can top; and a ring consisting of an incomplete circle of at least 180 degrees but less than 360 degrees and having an inside diameter approximately the same as the outside diameter of the can sidewall, the ring being connected to the plate at the plate's outer edge.

2. The closure of claim 1 in which the ring extends at least about 220 degrees.

3. The closure of claim 2 in which the ring extends less than 300 degrees.

4. The closure of claim 2 in which the plate is connected to the ring near a point halfway from the ends of the ring.

5. The closure of claim 2 in which the plate is connected to the ring near one end of the ring.

6. The closure of claim 3 in which the ring has an inside diameter of from two to three inches.

7. The closure of claim 6 in which the inside diameter is about 2.25 inches.

8. The closure of claim 6 in which the plate length is from about 0.5 to 1.5 inches.

9. The closure of claim 8 in which the plate has a width of from 0.75 to 2.0 inches at its widest point.

10. The closure of claim 9 in which the inner edge of the plate is curved concavely with a radius of from about 0.25 to 0.75 inches and the edge is sufficiently thin to fit beneath a portion of a pull tab on a beverage can.

11. The closure of claim 1 in which the plate is molded to follow the contours of the can top and rim.

12. The closure of claim 1 which also comprises a bulge near the outer edge of the plate for receiving pressure from a user's finger so as to rotate the closure on the can.

13. The closure of claim 3 in which inside surface of the ring protrudes so as to prevent the ring from freely sliding from the can sidewall over the rim of the can.

14. The closure of claim 13 in which the inside surface is concave.

15. The closure of claim 13 in which the inside surface is a pointed ridge.

16. The closure of claim 6 in which the height of the ring is from 0.05 to 0.25 inches.

* * * * *